US006010580A

United States Patent [19]

Dandliker et al.

[11] Patent Number: 6,010,580

[45] Date of Patent: Jan. 4, 2000

[54] COMPOSITE PENETRATOR

[75] Inventors: Richard B. Dandliker, Pasadena; Robert D. Conner, Hesperia; Michael A. Tenhover, Laguna Niguel; William L. Johnson, Pasadena, all of Calif.

[73] Assignee: California Institute of Technology, Pasadena, Calif.

[21] Appl. No.: 08/937,096

[22] Filed: Sep. 24, 1997

[51] Int. Cl.[7] ..... F42B 12/74

[52] U.S. Cl. ..... 148/403; 148/422; 148/423; 102/517; 102/518; 428/614

[58] Field of Search ..... 148/403, 422, 148/423, 561; 102/517, 518; 428/614

[56] References Cited

U.S. PATENT DOCUMENTS

| | | | |
|---|---|---|---|
| 3,776,297 | 12/1973 | Williford et al. | 164/86 |
| 4,330,027 | 5/1982 | Narasimhan | 164/461 |
| 4,523,625 | 6/1985 | Ast | 164/461 |
| 5,189,252 | 2/1993 | Huffman et al. | 102/517 |
| 5,288,344 | 2/1994 | Peker et al. | 148/403 |
| 5,440,995 | 8/1995 | Levitt | 102/517 |
| 5,567,251 | 10/1996 | Peker et al. | 148/522 |
| 5,567,532 | 10/1996 | Peker et al. | 428/457 |

*Primary Examiner*—George Wyszomierski
*Attorney, Agent, or Firm*—Christie, Parker & Hale, LLP

[57] ABSTRACT

A composite penetrator has a plurality of dispersed high aspect ratio bodies of refractory heavy metal such as tungsten wires. A matrix of metal surrounds and wets the dispersed bodies for forming an integral penetrator. The matrix metal is characterized by having localized shear band deformation when strained. The heavy metal is selected from the group consisting of tungsten, tantalum, hafnium, uranium and alloys thereof. A variety of matrix alloys may be used which will remain amorphous or microcrystalline in an object as large as the penetrator when cooled from the molten state. An exemplary amorphous alloy comprises 41.25 atomic percent zirconium, 41.25% titanium, 13.75% copper, 12.5% nickel and 22.5% beryllium.

28 Claims, 1 Drawing Sheet

COMPOSITE PENETRATOR

The U.S. Government has certain rights in this invention pursuant to Grant No. DAAH04-95-1-0233 awarded by the Army Research Office, Department of Defense.

BACKGROUND OF THE INVENTION

This invention relates to metal penetrators made of refractory heavy metal bodies dispersed in a metal that exhibits localized shear band deformation, such as an amorphous metal or nanocrystalline metal.

A kinetic energy penetrator is typically a high density body with a high aspect ratio which penetrates solid bodies by means of its own momentum. Kinetic energy penetrators have been made of diverse materials, but preferably have a high density so as to concentrate a large mass in a relatively small penetrating volume. Tungsten and cemented tungsten carbide are examples of materials which have been used for forming such penetrators. Typically, such a penetrator is in the form of a rod with an aspect ratio of about ten which may be flat, pointed or rounded on one end.

Generally speaking, such a penetrator should be a hard material so that it is not rapidly abraded as it penetrates. As previously mentioned, it is preferably very dense. It is also desirable to be a refractory material that readily resists the rapid heating which occurs during penetration.

Of great importance is the mechanical integrity of the penetrator which must resist significant deformation and/or breakage. It is unsatisfactory to have a penetrator that shatters upon impact or deforms so badly that it may flatten rather than penetrating. Thus, the mechanical properties of the penetrator are of utmost importance to its performance.

SUMMARY OF THE INVENTION

There is, therefore, provided in practice of this invention according to a presently preferred embodiment, a composite penetrator comprising a plurality of dispersed bodies of refractory heavy metal and a matrix of metal surrounding and wetting the dispersed bodies for forming an integral penetrator. The matrix metal has localized shear band deformation when strained.

An example of such a composite penetrator comprises a plurality of tungsten wires orientated along the axis of the penetrator and bonded together by an amorphous or nanocrystalline metal.

DRAWINGS

DESCRIPTION

Figure 1:
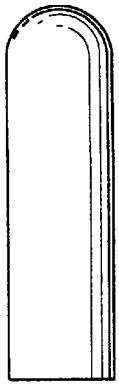
FIG. 1 illustrates in an elevation view an exemplary composite penetrator.

A kinetic energy penetrator is preferably in the form of a cylindrical rod in many cases is desirably pointed or rounded at one end as illustrated in the drawing. The rod need not have the illustrated shape of a hemisphere blending into a cylinder. A cone, ogive or even a blunt end may also be suitable. The penetrator may be used as a projectile on its own, in which case it may be launched with a sabot. Alternatively, the penetrator is encased in a more ductile metal such as aluminum, lead, copper and its alloys or steel depending on the target. This invention may be employed with any of such penetrators.

An exemplary composite penetrator has a plurality of tungsten wires 11 embedded in a substantially continuous matrix 12 of amorphous metal (metallic glass) or nanocrystalline metal. An exemplary glass-forming alloy is described in U.S. Pat. No. 5,288,344. Another exemplary alloy may be selected from International Application No. US96/01664 published Aug. 15, 1996. An exemplary alloy can be represented by the formula $Zr_{57}Cu_{15.4}Ni_{12.6}Nb_5Al_{10}$. Nanocrystalline material may, for example, be represented by the formulas $Ti_{34}Zr_{10}Ni_8Cu_{48}$ and $Ti_{65}Al_{10}Ni_{10}Cu_{15}$. The former of these nanocrystalline materials can be amorphous if cooled sufficiently rapidly, or can form nanocrystals if cooled more slowly from the molten state.

Figure 2:
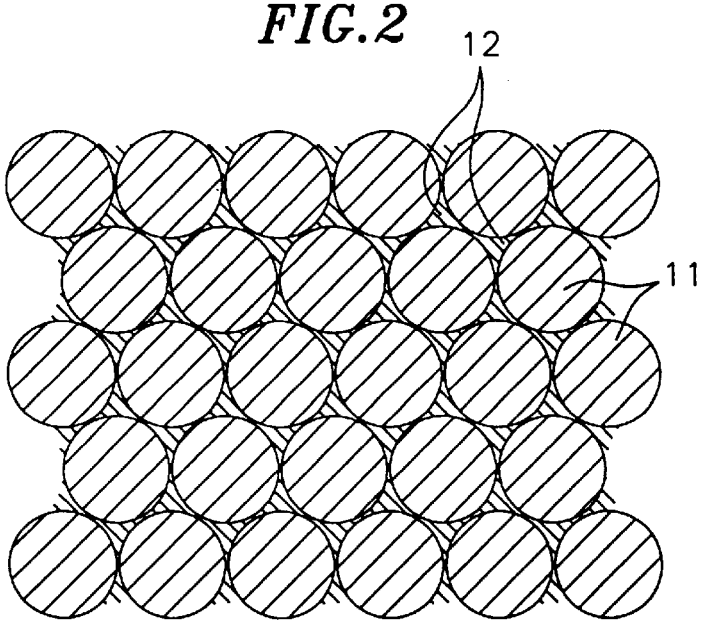
FIG. 2 is a fragmentary transverse cross-section of an exemplary penetrator.

In an exemplary embodiment, the tungsten wires are about 100 to 150 microns diameter, and are closely packed as seen in FIG. 2 so that the resulting composite has approximately 83% by volume tungsten wires and 17 percent by volume of an amorphous metal matrix. The size of the heavy metal dispersed phase can vary over a wide range depending on the size and shape of the penetrator being formed. Bodies from about 5 microns to 250 microns have been found satisfactory for various applications and it is anticipated that larger sizes are suitable for larger diameter penetrators.

More generally speaking, the improved penetrator comprises a dispersed phase of refractory heavy metal bodies in a matrix of localized shear band metal which surrounds and wets the dispersed bodies and bonds them together for forming an integral penetrator. The dispersed bodies of heavy metal may be spherical or randomly shaped particles, whiskers, fibers, ribbons, platelets, or wires, as in the exemplary embodiment. It is preferable that the bodies have an aspect ratio of at least ten. By aspect ratio it is meant that the length of the dispersed bodies is at least ten times the diameter (or transverse dimension in the case of ribbons) of the bodies. High packing density is possible with wires for achieving a high density penetrator, and even higher density is achieved with hexagonal wires. Preferably, the high aspect ratio bodies are orientated along the axis of the penetrator so that the long dimension is aligned with the direction of impact of the penetrator.

Alternatively, the dispersed phase may be metal particles (symmetrical or asymmetrical) presintered into a preform having the shape of the penetrator. Combinations of such arrangements may be used such as a perimeter of dispersed particles sintered together and a core of parallel wires of the same or a different heavy refractory metal (or vice versa). In any of these embodiments the localized shear band metal component forms an interconnected matrix which fills the space not occupied by the heavy metal.

The dispersed metal bodies may be a combination of high aspect ratio bodies, such as bodies having an aspect ratio of ten or more, and low aspect ratio bodies, such as particles with an aspect ratio of less than two. If so, it is preferred that the volume fraction of the high aspect ratio metal bodies be at least eight times the volume fraction of material with a low aspect ratio.

Figure 3:
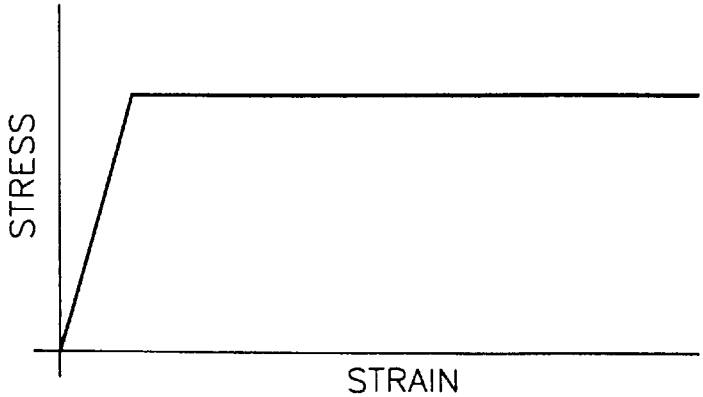
FIG. 3 is a stress-strain graph of typical localized shear band metal.

Localized shear band metal is a material that fails in shear along a very thin plane without work hardening. FIG. 3 is a stress-strain graph of typical localized shear band metal. Upon application of stress in a compression test, for example, the metal deforms perfectly elastically until the elastic limit is reached. Thereafter the metal deforms (strains) indefinitely in shear without further increase in stress. In some cases, the stress required for further deformation actually decreases. This phenomenon can be seen in a specimen that is bent, in the form of small "stair steps" on a surface where the shear bands intersect the surface. Sometimes such behavior has been referred to as superplasticity.

An amorphous metal is a good example of a localized shear band material which demonstrates a stress-strain curve as illustrated. Nanocrystalline metal is another example. A nanocrystalline alloy has crystals with an average grain size less than about 50 nanometers and preferably less than about 25 nanometers. Most preferred is a nanocrystalline material with an average grain size of about 10 nanometers. Such a material comprises crystallites about 10 nanometers across, dispersed in a matrix that is amorphous. When the crystallites are as small as 10 nanometers, shear bands essentially cannot penetrate the individual crystals and shear occurs along disordered grain boundaries or what might be considered an amorphous phase between the crystallites.

The exemplary localized shear band materials require relatively rapid cooling of the penetrator from the molten state of the matrix material. Metals normally crystallize when cooled from the melt. Many metals, however, can be retained in an amorphous state by rapid cooling. Elements and simple alloys require cooling rates in the order of $10^5$ to $10^6$ K/sec to remain amorphous. In recent years a number of alloys have been developed that remain amorphous with cooling rates below $10^3$ K/sec. It is such alloys that are suitable for forming penetrators of reasonable size. Some of these alloys and others that do not readily remain amorphous may cool into a nanocrystalline state with lower cooling rates. Both amorphous and nanocrystalline metals or others having localized shear band deformation when strained are suitable for matrix materials in a composite penetrator.

The heavy metal phase is preferably tungsten, however, it may also be tantalum, hafnium, uranium, tungsten-base alloy, tantalum-base alloy, or may itself be a composite such as by including small amounts of tungsten carbide in a metal matrix, for example. Generally speaking, the ductility of the heavy refractory metals is preferred. Refractory materials are preferred for their high melting points to resist destruction during penetration.

Other refractory metals with high density are also known and could perform well, but are regarded as too costly for most penetrator applications.

When a composite penetrator as described is deformed in a compression test, for example, localized shear bands can be observed on a surface of the penetrator. As little as 20% by volume, or less, of localized shear band metal in the composite causes localized shear in the dispersed metal phase. Examination shows that tungsten wires are sheared in bands as if the tungsten was a localized shear band material.

Exemplary penetrators were made with ten mil (250 micrometers) tungsten wires tightly packed and infiltrated with an alloy comprising 41.25 atomic percent zirconium, 13.75% titanium, 12.5% copper, 10% nickel and 22.5% beryllium. Each penetrator was a ¼ inch (6.35 mm) diameter, 1½ or 2 inch (3.8 or 5.1 cm) long right circular cylinder with flat ends. The tungsten wires were oriented parallel to the axis of the penetrator. A typical penetrator made this way has about 80% by volume of the heavy metal phase and about 20% amorphous metal phase. Average density of such a penetrator is about 17 g/cm$^3$ or higher. The infiltration technique produces a penetrator having little or no final porosity. Typically, porosity is less than 2%.

When impacted into a semi-infinite block of aluminum alloy, the penetrator was somewhat sharpened on the tip and did not mushroom at all. When impacted into 4130 steel at 1200 m/sec, the heavy metal composite penetrator has a penetration ratio, i.e., penetration depth over original penetrator length, about 10% better than a tungsten alloy penetrator.

This deep penetration is clearly due to the presence of the metallic glass phase. It is believed that this is associated with a "self-sharpening" behavior of the composite penetrator. This may be attributed to the tendency for dynamic deformation to occur in very narrow localized shear bands within a metallic glass or nanocrystalline material. Only a relatively small volume fraction, e.g., about 20% by volume, of metallic glass or nanocrystalline metal dispersed through the penetrator can provide good penetration capability.

The volume percent of an amorphous metallic alloy desired in the penetrator depends on the metal of the dispersed phase, the alloy of the amorphous metal matrix, the shape and size of the heavy metal phase, and if anisotropic, its orientation relative to the stress direction. Up to about 20 percent by volume amorphous metal appears appropriate for a composite penetrator. A higher proportion of metallic glass phase in the penetrator generally results in higher ductility, which may be desirable with some dispersed metal phases or specific applications of the penetrator, however, there is a decrease in density of the penetrator. Preferably the dispersed bodies of refractory heavy metal comprise at least 80 volume percent of the composite and the metallic matrix comprises the other 20 percent or less.

High density is important for deep penetration. It is preferred that the average density of the composite material making up the penetrator be at least 14 gm/cm$^3$ and preferably 16 gm/cm$^3$ or more. High density is achieved by selection of the heavy metal phase which occupies most of the volume of the penetrator. Preferably, the matrix metal phase also has a high density so that the average density is high.

A composite suitable for penetrators which deform along localized shear bands when strained has dispersed bodies of refractory heavy metal in a matrix of amorphous or nanocrystalline metal. There are two preferred classes of alloys that when cooled rapidly enough will remain amorphous or form nanocrystalline structures. Such alloys also have good strength and wetting characteristics which make them preferred for penetrators. One class of matrix alloys includes metals from each of three groups, namely (a) iron, nickel, cobalt, chromium and silver, (b) copper, aluminum, zinc, silicon, beryllium and boron, and (c) zirconium, titanium and hafnium. The other class of preferred matrix alloys is at least a quaternary alloy including metals from each of two groups, namely (a) iron, copper, nickel, cobalt, chromium, silver and silicon, and (b) zirconium, titanium and hafnium, with at least two metals being in the first group.

When such alloys are used as a matrix for a major portion of refractory heavy metal, the penetrator has an average composition of more than 70 atomic percent metal selected from the group consisting of tungsten, tantalum and uranium, more than 5 atomic percent metal selected from the group consisting of iron, nickel, cobalt, chromium and silver, more than 2 atomic percent metal selected from the group consisting of copper, aluminum, zinc, silicon, beryllium and boron, and more than 5 atomic percent metal selected from the group consisting of zirconium, titanium and hafnium; or the penetrator has an average composition of more than 70 atomic percent metal selected from the group consisting of tungsten, tantalum and uranium, more than 8 atomic percent metal selected from the group consisting of iron, copper, nickel, cobalt, silver, chromium and silicon, and more than 8 atomic percent metal selected from the group consisting of zirconium, titanium and hafnium, with the matrix alloy being at least a quaternary alloy with at least two metals selected from the first group. A number of specific compositions of suitable matrix alloys are described in U.S. Pat. No. 5,288,344 and in International Application No. US96/01664 published Aug. 15, 1996.

Furthermore, it is preferred that a major portion of the penetrator have a body centered cubic crystal structure and a minor portion is either amorphous or a nanocrystalline metal. The refractory metals tantalum and tungsten are preferred because of high density and mechanical strength. Tungsten and its alloys are particularly preferred.

A feature of the matrix metal phase is that it wets the surface of the dispersed metal phase. Wetting is important for some fabrication techniques. It also assures that there is a strong interfacial bond between the dispersed particles and the matrix metal. High strength as well as the high strain to failure characteristics of the amorphous or nanocrystalline metal phase is also desirable. Preferably, the amorphous or nano-crystalline matrix has a yield strength of at least 2 GPa (two gigaPascals). High strength of the penetrator matrix along with the strength of the interfacial bond and the strength of the dispersed bodies assures structural integrity of the penetrator under the high stresses occurring during impact penetration.

Infiltration of a molten glass-forming or nanocrystal-forming alloy is a suitable technique for forming a penetrator when the dispersed heavy metal phase is in the form of sintered ductile metal particles or fibers, or a porous metal matrix of oriented wires. Infiltration may also be used for loose powders or fibers contained in a mold of suitable shape.

An exemplary infiltration technique can be as follows:

A bundle of tungsten wires is placed in the bottom of a close fitting quartz tube having the size and shape of the desired penetrator. The quartz tube is necked down above the bundle of wires to have an inside diameter sufficiently small to support a mass of liquid glass-forming alloy by reason of surface tension of the glass-forming alloy. A suitable sized mass of glass-forming alloy is placed in the quartz tube above the narrow constriction and the tube is evacuated.

The glass-forming alloy is then melted by induction heating, intense radiation or in a tube furnace. The molten alloy is retained above the constriction until ready for infiltration. At that time an inert gas is introduced into the upper end of the quartz tube, causing the molten metal to pass through the narrow constriction and into the portion of the tube containing the bundle of fibers. The metals are then held at a temperature above the melting point of the glass-forming alloy for a sufficient time to assure complete infiltration and wetting of the tungsten wires by capillary action. For example, holding an alloy having a composition of 41.2% (atomic percent) zirconium, 13.8% titanium, 10% nickel, 12.5% copper and 22.5% beryllium, at about 800° C. for 30 minutes assures complete infiltration of a bundle of tungsten wires having 17% of open volume in the bundle. When complete infiltration is assured, the quartz tube containing the composite can be quenched in water to cool the glass-forming alloy at a sufficient rate to maintain it in an amorphous or nanocrystalline state.

Maintaining the molten alloy in contact with the reinforcing wires for a protracted period for thorough infiltration has not been found to be a problem. With the aforementioned alloy and tungsten wires, a minimal amount of surface erosion can be seen on wires after 2 to 2½ hours of immersion. The glass-forming alloys are quite viscous near their melting points and a rather small amount of diffusion of dissolved metal occurs during reasonable processing times. High viscosity in the molten alloy requires appreciable time to assure complete infiltration. Although the solution of metal from the wires may change the composition of the glass-forming alloys sufficiently to form a thin skin of crystalline material adjacent to the surface of the heavy metal wire. The bulk of the glass-forming alloy remains amorphous or nanocrystalline.

It is also desirable to superheat a glass-forming alloy above the infiltration temperature and lower the temperature to a processing temperature before infiltration. This "superheating" of the glass-forming alloy is at a temperature greater than the liquidus temperature of impurity oxides that may be present in the glass-forming alloy.

Even commencing with high purity metals and when great care is taken during processing, one finds that a small amount of oxygen is typically present in the glass-forming alloy. It is hypothesized that there are small amounts of metal oxide as a separate phase in the glass-forming alloy. The oxide acts as a heterogeneous nucleant so that less undercooling of the molten alloy is obtained before crystallization. When the glass-forming alloy is superheated above the oxide liquidus temperature, any oxide as a separate phase dissolves in the molten glass-forming alloy. Any subsequent heterogeneous nucleation detrimental to the glass-forming ability of the alloy must follow homogeneous nucleation of oxide dissolved in the alloy.

Experimentally, it is found that superheating the glass-forming alloy to a temperature greater than the oxide liquidus temperature significantly enhances the glass forming ability. The higher temperature above the oxide liquidus temperature is higher than desired for infiltration. Thus, the preferred technique is to superheat the alloy sufficiently to dissolve the oxides and then lower the temperature of the alloy to the processing temperature before infiltrating the alloy into the heavy metal phase.

For example, an alloy comprising 52.5% (atomic percent) of zirconium, 5% titanium, 17.9% copper, 14.6% nickel and 10% aluminum has a distinct melting temperature at 796° C. To assure thorough solution of oxides in the glass-forming alloy, heating above 942° C. has been found sufficient. Heating to a slightly higher temperature is desirable and the time interval for superheating can be rather short, typically, less than a minute. After such a superheating step, the alloy may be cooled to a processing temperature somewhat above its melting temperature and held for an appreciable time without degrading its glass forming ability. An exemplary processing temperature for infiltration is about 100° C. above the melting point of the glass-forming alloy.

Alternatively, one may heat a glass-forming alloy to a processing temperature and infiltrate the molten alloy into a permeable mass of heavy metal and thereafter superheat for dissolving oxide impurities. The superheating may be for a shorter interval than infiltration and not dissolve an undue amount of metal from the heavy metal phase. Generally, it is preferred not to infiltrate at the superheating temperature because of the risk of solution of heavy metal. Which technique is suitable will depend in part on the specific metals used.

What is claimed is:

1. A composite kinetic energy penetrator comprising:

a plurality of dispersed bodies of refractory heavy metal; and a matrix of amorphous or nanocrystalline metal surrounding and wetting the dispersed bodies for forming an integral kinetic energy penetrator, the matrix metal being characterized by generation of localized shear band deformation upon it being strained at deformation rates characteristic of kinetic energy penetration.

2. A composite kinetic energy penetrator according to claim 1 wherein the heavy metal is selected from the group consisting of tungsten, tantalum, uranium, hafnium and alloys thereof.

3. A composite kinetic energy penetrator according to claim 1 wherein the matrix metal comprises an amorphous metal.

4. A composite kinetic energy penetrator according to claim 1 wherein the matrix metal is a nanocrystalline metal.

5. A composite kinetic energy penetrator according to claim 1 wherein the matrix metal has a grain size less than 50 nanometers.

6. A composite kinetic energy penetrator according to claim 1 wherein the matrix metal has a grain size of about 10 nanometers.

7. A composite kinetic energy penetrator according to claim 1 wherein the matrix metal has a yield strength greater than two gigaPascals.

8. A composite kinetic energy penetrator according to claim 1 wherein the heavy metal bodies comprise at least 80 percent of the volume of the penetrator.

9. A composite kinetic energy penetrator according to claim 1 wherein the matrix metal is capable of deforming without work hardening.

10. A composite kinetic energy penetrator according to claim 1 wherein the heavy metal bodies are in the form of parallel high aspect ratio bodies.

11. A composite kinetic energy penetrator according to claim 10 wherein the high aspect ratio bodies are oriented parallel to an axis of the penetrator.

12. A composite kinetic energy penetrator according to claim 1 wherein the heavy metal bodies are in the form of particles.

13. A composite kinetic energy penetrator according to claim 1 wherein the penetrator has a density of at least 14 $gm/cm^3$.

14. A composite kinetic energy penetrator having either an average composition of more than 70 atomic percent metal selected from the group consisting of tungsten, tantalum and uranium as a separate phase, in an amorphous or nanocrystalline matrix providing an average composition of more than 8 atomic percent metal selected from a first group consisting of iron, copper, nickel, cobalt, silver, chromium and silicon, and more than 8 atomic percent metal selected from a second group consisting of zirconium, titanium and hafnium, with the matrix alloy being at least a quaternary alloy with at least two metals selected from the first group; or an average composition comprising more than 70 atomic percent metal selected from the group consisting of tungsten, tantalum and uranium as a separate phase, in an amorphous or nanocrystalline matrix providing an average composition of more than 5 atomic percent metal selected from the group consisting of iron, nickel, cobalt, chromium and silver, more than 2 atomic percent metal selected from the group consisting of copper, aluminum, zinc, silicon, beryllium and boron, and more than 5 atomic percent metal selected from the group consisting of zirconium, titanium and hafnium.

15. A composite kinetic energy penetrator according to claim 14 wherein the penetrator has a density of at least 14 $gm/cm^3$.

16. A composite kinetic energy penetrator according to claim 14 comprising dispersed bodies of metal selected from the group consisting of tungsten, tantalum and alloys thereof and a matrix of other metals surrounding and wetting the dispersed bodies.

17. A composite kinetic energy penetrator according to claim 16 wherein the matrix metal is characterized by generation of localized shear band deformation upon it being strained at deformation rates characteristic of kinetic energy penetration.

18. A composite kinetic energy penetrator according to claim 16 comprising a major portion of dispersed bodies having a body centered cubic crystal structure and a minor matrix portion being either an amorphous metal or a nanocrystalline metal.

19. A composite generally cylindrical kinetic energy penetrator comprising:

a plurality of refractory heavy metal wires oriented along the axis of the penetrator; and a matrix of metal surrounding and wetting the wires for bonding the wires together, the matrix metal being an amorphous metal or a nanocrystalline metal.

20. A composite kinetic energy penetrator according to claim 19 wherein the matrix metal has a grain size of about 10 nanometers.

21. A composite kinetic energy penetrator according to claim 19 wherein the heavy refractory metal is selected from the group consisting of tungsten and tungsten alloys.

22. A composite kinetic energy penetrator comprising:

a plurality of dispersed bodies of heavy metal having an aspect ratio of at least ten; and a matrix comprising sufficient localized shear band amorphous or nanocrystalline metal surrounding the dispersed bodies for causing the penetrator to deform with localized shear bands upon it being strained at deformation rates characteristic of kinetic energy penetration.

23. A composite kinetic energy penetrator according to claim 22 wherein the heavy metal has a body centered cubic crystal structure and the matrix metal is either an amorphous metal or a nanocrystalline metal.

24. A composite kinetic energy penetrator according to claim 22 wherein the matrix metal has a yield strength greater than two gigaPascals.

25. A composite kinetic energy penetrator according to claim 22 wherein the metal bodies comprise at least 80 percent of the volume of the penetrator.

26. A composite kinetic energy penetrator according to claim 25 wherein the heavy metal bodies are oriented parallel to an axis of the penetrator.

27. A composite kinetic energy penetrator wherein the penetrator has a density of at least 14 $gm/cm^3$.

28. A composite kinetic energy penetrator comprising:

a plurality of dispersed bodies of heavy metal having an aspect ratio of at least ten and a plurality of dispersed bodies having an aspect ratio of less than two, wherein the volume fraction of high aspect ratio bodies is greater than eight times the volume fraction of low aspect ratio bodies; and a matrix comprising sufficient localized shear band metal surrounding the dispersed bodies for causing the penetrator to deform with localized shear bands upon it being strained at deformation rates characteristic of kinetic energy penetration.

* * * * *